US005881932A

United States Patent [19]

Wadden

[11] Patent Number: 5,881,932

[45] Date of Patent: Mar. 16, 1999

[54] CONVERTIBLE BAG

[76] Inventor: Michael M. Wadden, 1039 W. Belden Ave., Chicago, Ill. 60614

[21] Appl. No.: 980,675

[22] Filed: Dec. 1, 1997

[51] Int. Cl.[6] ..... A45F 3/04; A45F 4/02

[52] U.S. Cl. ..... 224/153; 224/580; 224/627; 224/629; 224/645; 224/162; 150/108

[58] Field of Search ..... 224/153, 577, 224/578, 579, 580, 162, 191, 627, 628, 629, 630, 645, 650, 652, 653, 654, 657, 907; 150/107, 108; 190/109, 124, 127

[56] References Cited

U.S. PATENT DOCUMENTS

| | | | |
|---|---|---|---|
| 1,397,161 | 11/1921 | Clemetson . | |
| 3,198,300 | 8/1965 | Tuttle . | |
| 3,295,643 | 1/1967 | Peterson et al. | 190/125 |
| 3,622,056 | 11/1971 | Droeger . | |
| 3,995,802 | 12/1976 | Johnston | 224/580 |
| 4,236,657 | 12/1980 | Brunton | 224/153 |
| 4,287,971 | 9/1981 | Doulet . | |
| 4,513,866 | 4/1985 | Thomas . | |
| 4,561,576 | 12/1985 | Lowe et al. . | |
| 4,658,999 | 4/1987 | Hilty . | |
| 4,693,346 | 9/1987 | Eversdijk . | |
| 4,796,735 | 1/1989 | Horiuchi . | |
| 4,887,751 | 12/1989 | Lehman . | |
| 4,961,522 | 10/1990 | Weber | 224/153 |
| 5,027,874 | 7/1991 | Gazzola . | |
| 5,072,867 | 12/1991 | Zingale | 224/162 |
| 5,294,029 | 3/1994 | Shimura et al. . | |
| 5,361,955 | 11/1994 | Gregory | 224/907 |
| 5,370,287 | 12/1994 | Cormier | 224/153 X |
| 5,415,332 | 5/1995 | Kliot . | |
| 5,456,353 | 10/1995 | Challoner et al. . | |
| 5,529,229 | 6/1996 | Fier . | |
| 5,570,829 | 11/1996 | Harrison | 224/153 |
| 5,639,004 | 6/1997 | Carlton et al. | 190/125 |
| 5,749,503 | 5/1998 | Wulf et al. | 224/580 X |
| 5,799,851 | 9/1998 | Wulf et al. | 224/580 X |

FOREIGN PATENT DOCUMENTS

| | | | |
|---|---|---|---|
| 2608388 | 6/1988 | France | 150/108 |
| 4237364 A1 | 5/1994 | Germany | 150/108 |
| 86560 | 10/1955 | Sweden | 224/209 |

*Primary Examiner*—Alian N. Shoap
*Assistant Examiner*—Gregory M. Vidovich
*Attorney, Agent, or Firm*—Welsh & Katz, Ltd.

[57] ABSTRACT

A bag is convertible between a hand-held bag, a shoulder bag and a backpack. The bag includes a bag body defining an interior storage space. A top handle is positioned on a top portion of the body. The bag includes a pair of discrete, separate shoulder straps and a pair of independently operable shoulder strap retraction systems. Each of the retraction systems includes at least one reel-type winding device operably connected to a respective strap for storing and selectively retracting and withdrawing a portion of the respective shoulder straps. Each reel-type device is positioned in the bag at least in part within the interior storage space, and overlying a respective opening in the bag to withdraw and retract the respective shoulder strap therefrom. Each strap is selectively positionable at a retracted position, a withdrawn position, and an intermediate position. Each strap is independently withdrawable from the bag from about the reel-type device to the withdrawn position to convert the bag from the hand-held bag to a shoulder bag. Both straps are independently withdrawable from and retractable into the bag to the intermediate position, to convert the bag from the hand-held or shoulder bag to a backpack. Each strap is independently adjustable in the intermediate position to provide a snug fit of the backpack to a user's back.

14 Claims, 4 Drawing Sheets

CONVERTIBLE BAG

FIELD OF THE INVENTION

This invention pertains to a convertible bag that can be carried as a shoulder bag, a briefcase or a backpack. More particularly, the invention pertains to a bag having a handle for carrying the bag and having a pair of retractable shoulder straps for converting the bag to, and carrying the bag as a shoulder bag or a backpack.

BACKGROUND OF THE INVENTION

A wide variety of briefcases, backpacks, shoulder bags and the like are in use every day for carrying books, papers and computers between the home, office, school and the like. Numerous bags are known in the art which can convert from a briefcase-type or hand-type bag, that is, one that has a handle positioned on the top of the bag, to, for example, a shoulder bag having a strap that permits carrying the bag from one's shoulder. Bags are also known that can be converted from briefcases to backpacks. Likewise, shoulder bags are known that can be converted to backpacks, to permit "hands-free" carrying of materials.

Those who have had occasion to carry relatively heavy objects in such bags, particularly on a frequent basis, will recognize the various anatomical problems that can arise as a result of carrying a substantially heavy object. In particular, those who frequently carry laptop computers and the like will recognize the significant strain that can be placed on one's arms, shoulders and back from carrying these objects in a briefcase, a shoulder bag, or a backpack that is not suitably designed for carrying such objects.

Some of the known convertible bags are configured as "day-packs" that include shoulder straps and a handle positioned at the top of the pack. One drawback to this arrangement is, that when carried as a briefcase from the top handle, the straps merely hang from the bag and can become caught on other objects, or the straps can become entangled in one's legs. In addition, such hanging straps can be rather unsightly. This can be particularly problematic when such a bag is required to provide a neat and clean appearance.

To alleviate the unsightly "hanging strap problem", bags have been configured to permit manually pulling or retracting the straps into the bag. As will be recognized, these retracted straps can still hang from the bag or be readily pulled therefrom. In addition, the manually retracted straps may not provide a desirable, neat appearance.

One known bag includes a device that permits suspending a strap therefrom which device permits winding the strap onto a roller, and permits extracting the strap therefrom. Although such a bag alleviates the problem of unsightly or dangling straps, there still exists various other problems of the known convertible bags.

Accordingly, there continues to be a need for a convertible bag that can be used as a briefcase, a shoulder bag or a backpack. Such a bag permits carrying relatively heavy objects in a backpack-style bag, while providing the flexibility of converting between a briefcase, shoulder bag or backpack, and permits fully retracting the straps into the bag to provide a neat and clean appearance.

SUMMARY OF THE INVENTION

A bag that is convertible between a hand-held bag, a shoulder bag and a backpack includes a bag body defining an interior storage space. A top handle is positioned on a top portion of the body. The bag includes a pair of discrete, separate shoulder straps and a pair of independently operable shoulder strap retraction systems. Each of the retraction systems includes at least one reel-type winding device operably connected to a respective strap for storing and selectively retracting and advancing a portion of the respective shoulder strap.

Each of the reel-type devices is positioned in the bag, at least in part within the interior storage space. The reel-type devices overly a respective opening in the body to withdraw and retract the respective shoulder strap therefrom. Each strap is selectively positionable at a retracted position, a withdrawn position and an intermediate position. The straps are configured such that each strap is independently withdrawable from the bag from about the reel-type device to the withdrawn position to convert the bag from the hand-held (e.g., briefcase) bag to a shoulder bag. Both straps are independently withdrawable from and retractable into the bag, each to the intermediate position, to convert the bag from the hand-held or shoulder bag to a backpack.

Each strap is independently adjustable in the intermediate position to provide a snug fit of the backpack to a user's back.

In a preferred embodiment, the bag is configured as a hand-held type briefcase having a top wall, a bottom wall, a pair of side walls, a front wall and a back wall. Preferably, at least one opposing pair of walls have an hourglass shape to facilitate carrying the bag and to provide a comfortable fit of the bag as both a shoulder bag and a backpack. Most preferably the top and bottom walls have an hourglass shape.

In the briefcase configuration, the top handle is positioned on the top wall and each shoulder strap extends from the top wall, spaced from the handle, to a respective side wall. The bag can be configured such that each of the retraction systems includes one reel-type winding device. Alternately, each retraction system can include a pair of reel-type devices, each connected to a respective end of each strap.

Most preferably, the interior storage space is divided into a plurality of segregated storage regions, with one region configured for storing, for example, a laptop computer. The bag can also include at least one pocket positioned on an inside surface of the front wall. The pockets can be configured having zippered closures or mechanical hook and loop-type closures running along two sides of the pocket so that the pocket can be accessed when the bag is positioned in an upright position resting on the bottom or positioned such that one side of the bag is resting on the ground.

The bag can include a zipper-type closure for closing the bag. Other closure devices, such as snap locks and the like, can also be used.

In a most preferred embodiment, the bag is formed having a layered construction. The layered construction includes an inner shell and an outer shell that can be formed of, for example, lightweight rugged materials such as a heavy gauge nylon or kevlar-type material. Preferably the layered construction includes at least one layer of a closed cell, non-absorbing foam or like material to provide shock absorption. The layered construction can further include a substantially rigid member disposed between the inner and outer shells to provide and maintain the hourglass shape.

Other features and advantages of the present invention will be apparent from the following detailed description, the accompanying drawings, and the appended claims.

DETAILED DESCRIPTION OF THE PREFERRED EMBODIMENTS

Figure 1:
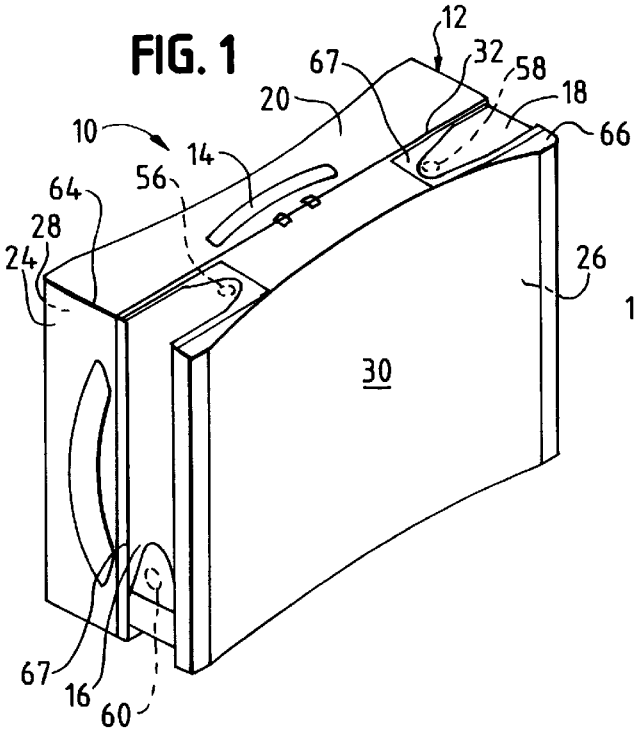
FIG. 1 is a front perspective view of a bag that is convertible from a hand-carry bag to a shoulder bag and to a backpack, in accordance with the principles of the present invention.
Figure 2:
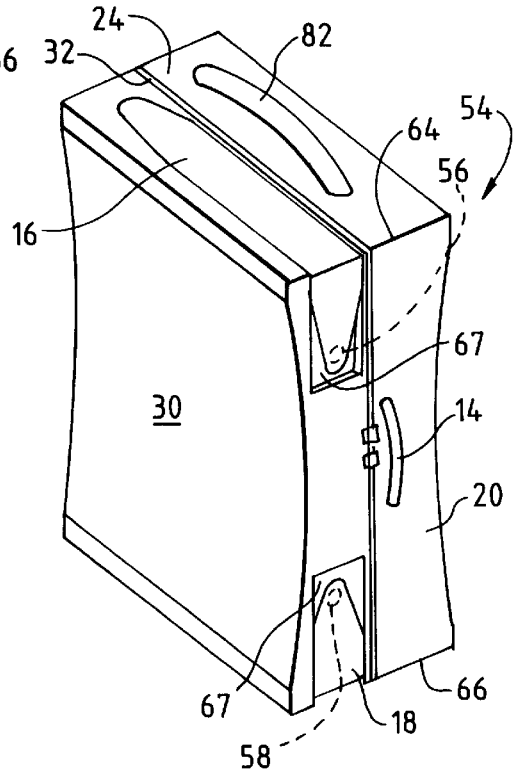
FIG. 2 is a perspective view of the bag of FIG. 1, with the bag positioned resting on a side, with an opposing side oriented vertically upward.
Figure 3:
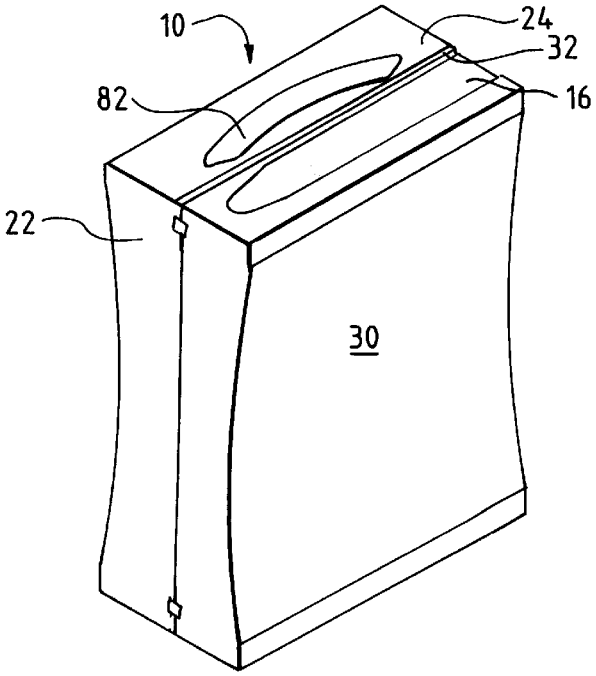
FIG. 3 is a rear perspective view of the bag oriented as shown in FIG. 2.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

With reference now to the figures, and in particular to FIG. 1, there is shown a convertible bag 10 in accordance with the principals of the present invention. In one embodiment, the bag 10 includes a main body 12, a handle or hand grip 14, and first and second mirror image retractable shoulder straps 16, 18. The exemplary bag 10 illustrated in FIG. I is configured as a briefcase and includes a top wall 20, a bottom wall 22, a pair of side walls 24, 26 and front and back walls 28, 30.

Figure 5:
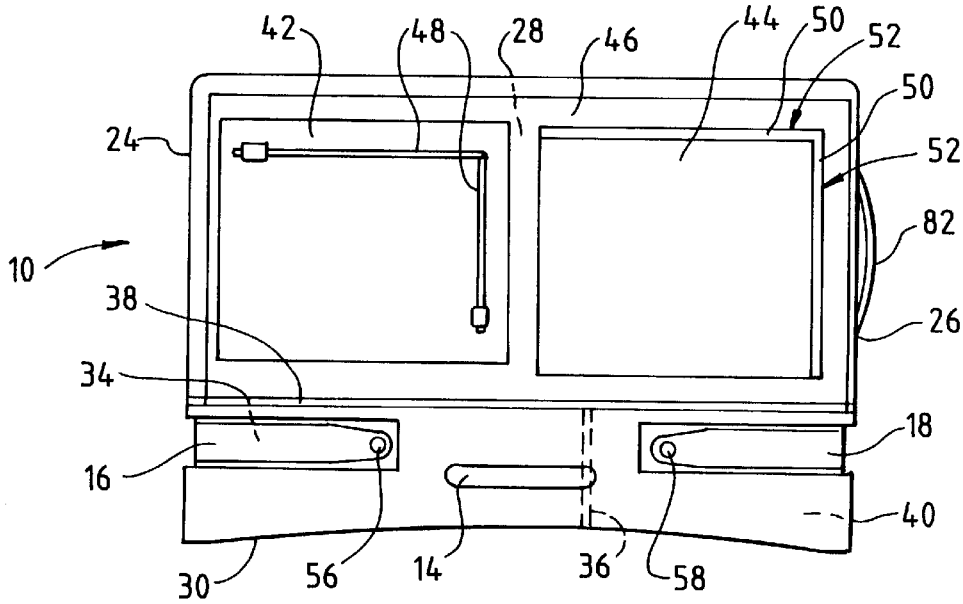
FIG. 5 is a front view of the bag with the top portion thereof open, illustrating pockets on an interior surface of the front wall of the bag.

When the bag 10 is sealed by, for example, the illustrated zipper 32, the walls 20–30 define an interior storage region or volume as indicated at 34 in FIG. 5. The interior storage volume 34 can be configured as one large undivided region, or, alternately, the interior storage volume 34 can be configured with one or more dividers 36 to define a plurality of storage areas or compartments as indicated at 38 and 40. In one contemplated configuration, the interior storage region includes at least one divider to define an area for storage of a laptop computer or like device.

Figure 6:
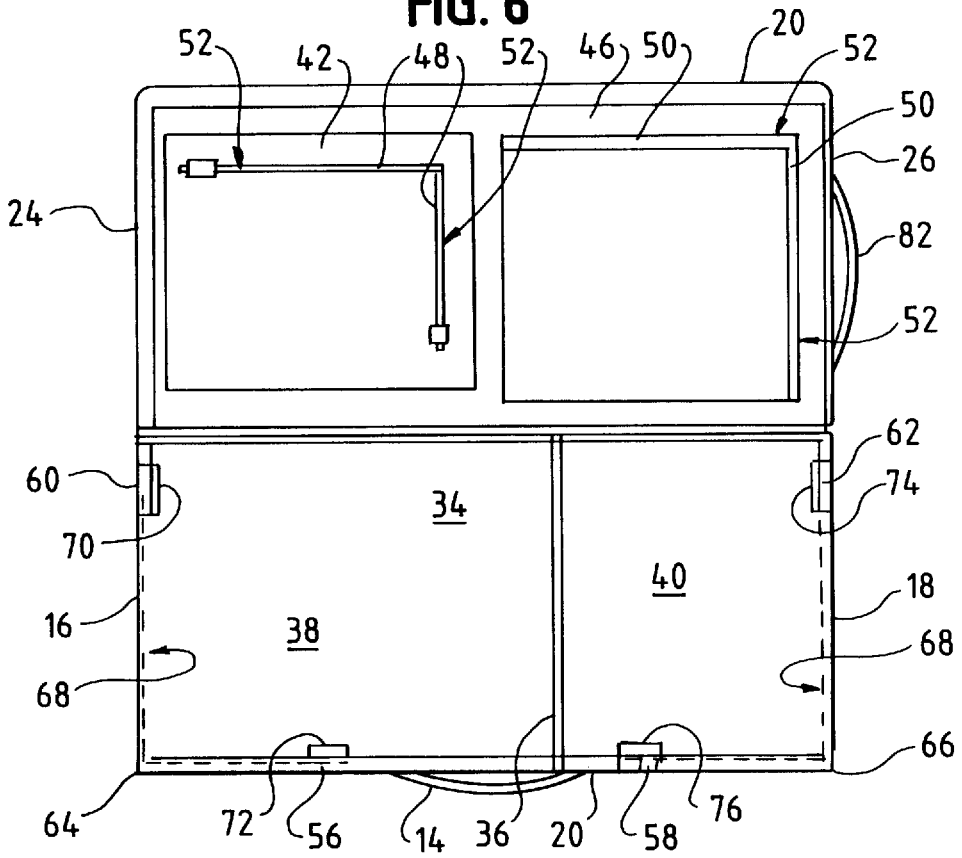
FIG. 6 is a top view of the bag of FIG. 5, shown with the front and rear portions folded downwardly so as to illustrate the interior portion of the bag.

Referring to FIGS. 5–6, the bag 10 can further include pockets 42, 44 or the like that can be sealed. The pockets 42, 44 can be positioned on an inner surface 46 of the front wall 28 of the bag 10. Those skilled in the art will recognize that pocket sealing can be provided by zippers as illustrated at 48, mechanical hook and loop fastening tapes as illustrated at 50 and the like. Advantageously, the pockets 42, 44 can include one or more sealable sides as shown at 52, such that the pockets 42, 44 can be accessed from an upright pocket portion when the bag 10 is positioned resting on the bottom surface 22 or resting on a side 24.

In a preferred embodiment, the bag 10 is ergonomically detailed for maximum user comfort. Referring to FIGS. 1–4, such ergonomic detailing can include an hourglass configuration when viewed as illustrated generally at 54 from the top or bottom of the bag 10. That is, the front and rear walls 28 and 30 of the bag 10 have a concave shape so that the bag 10 can more comfortably fit to a user's back or hip, as will be described in more detail herein. Other walls or portions of the bag 10 may be likewise ergonomically designed to provide a comfortable, reduced-stress configuration. All such ergonomic design details are within the scope of the present invention.

The bag 10 includes a top handle 14 that is permanently mounted to the top wall 20 of the bag 10. In a preferred embodiment, the top handle 14 is formed of a material that is lightweight and strong, and at the same time is sufficiently flexible to conform to a user's hand. Preferably, the material is somewhat porous so that it can absorb moisture. A contemplated material is that commonly referred to as "bungee cord" which is available in a variety of sizes (e.g., diameters) and provides a number of desirable characteristics, such as those presented above. Nevertheless, a wide variety of materials can be used for the handle 14, which other materials are within the scope of the present invention.

Figure 4:
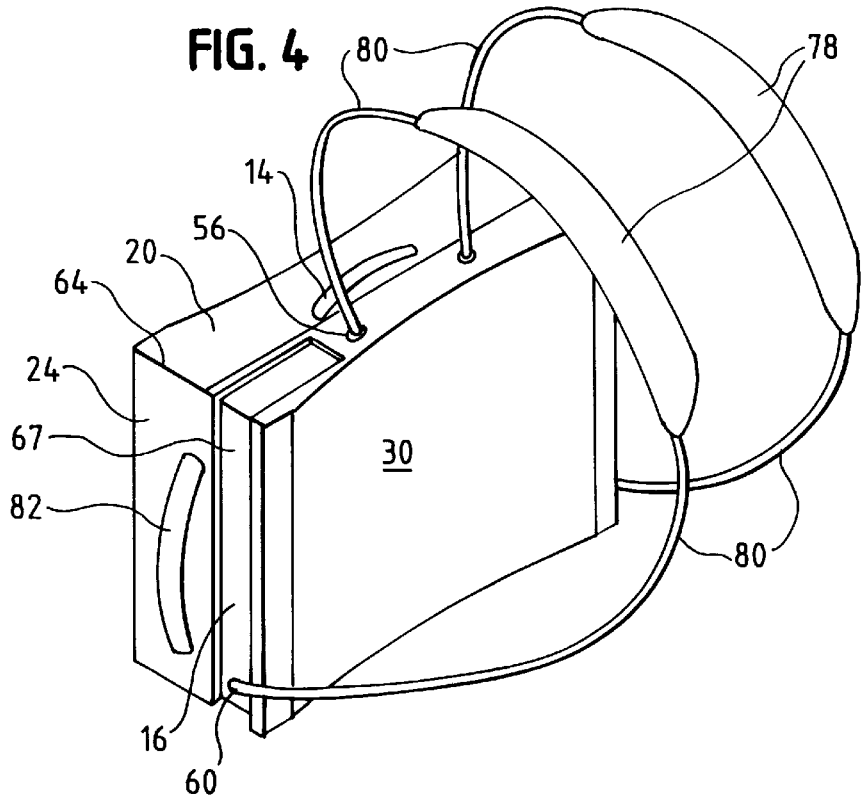
FIG. 4 is a front perspective view of the bag oriented as in FIG. 1, illustrated with both of the shoulder straps deployed for use of the bag as a backpack.

The bag 10 includes a pair of symmetrically disposed shoulder straps 16, 18, as shown in FIG. 4. The shoulder straps 16, 18 are fully retractable into the bag 10 and can be withdrawn readily therefrom. In a preferred configuration, each of the shoulder straps 16, 18 is retractably mounted to the bag 10 through openings 56, 58 and 60, 62 formed in the bag 10 through the top wall 20 or the side walls 24, 26. Alternately, the bag 10 can be configured having openings formed in both the top and side walls for withdrawing and retracting the straps. The strap top wall openings 56, 58 are spaced from one another and spaced from the top side edges of the bag indicated generally at 44, as shown in FIG. 4. The side wall openings 60, 62 are positioned on respective side walls 24, 26 spaced from the edges 64, 66 adjacent to the top wall openings 56, 58. In this configuration, the shoulder straps 16, 18 extend substantially along the length of the side walls 24, 26 from which they extend and along a portion of the top wall 20. As is seen in FIGS. 1–4, the bag 10 can be configured so that the straps 16, 18, when retracted into the bag 10, are positioned within recessed areas 67 in the bag 10, to provide a neat, flush appearance.

Referring now to FIG. 6, there is shown a figure illustrating a portion of the interior of the bag 10, that illustrates the retraction system 68. The retraction system 68 includes the pair of shoulder straps 16, 18 each shoulder strap being mounted to the bag 10 by at least one, and preferably a pair of reel-type winding devices 70–76. A preferred winding device 70–76 permits controlled, stepless extraction or withdrawal of the strap 16, 18 from the device 70–76 and likewise, controlled, stepless retraction of the strap 16, 18 back into the device 70–76.

One known device 70–76 permits locking the strap 16, 18 at a given withdrawal position by tugging or snapping the strap 16, 18 thereby activating an inertial-type locking mechanism. A contemplated device 70–76 for this use is illustrated in U.S. Pat. No. 5,294,029 to Shimura, et al. which patent is incorporated herein by reference. In a most preferred embodiment, the bag 10 includes four retracting devices 70–76, each positioned within the internal storage region 34 of the bag 10 at about, and overlying, the requisite side and top wall openings 56–62. In this configuration, the openings 56–62 through the bag side and top walls 24, 26, 20 do not open directly into the bag internal region 34, but open through the walls 24, 26, 20 where the retracting devices 70–76 overlie the openings 56–62.

In a preferred embodiment, the straps 16, 18 can be withdrawn or retracted to provide the desired strap length.

For example, one or both straps 16, 18, independently, can be withdrawn to a fully or substantially fully withdrawn position, retracted to a retracted position, or set at an intermediate position between the retracted and withdrawn positions.

A preferred shoulder strap includes a padded portion as illustrated at 78 that is generally coextensive with that portion of the strap 16, 18 that is exterior of the bag 10 when the strap 16, 18 is in the fully retracted position. The strap 16, 18 lies flush to the top 20 and side 24, 26 of the bag 10, within the recessed region 67, extending from or between the openings 56–62. In this manner, the flush positioned strap 16, 18 provides a neat and clean appearance. Thus, when the bag 10 is used as a hand-type bag, it provides an aesthetically pleasing, acceptable outward appearance.

The remaining portion of the shoulder strap 80, that is, the portion that is not intended to lie on a user's shoulder, can be formed of any of a wide variety of materials, such as web-type straps, bungee cord material and the like. A preferred non-visible (i.e., retracted into the bag, onto the reel) strap portion 80 is formed of a web-type material, commonly used for backpack straps. Most preferably, the web material has a width of between about ¼ and ½ inch. It is contemplated that a relatively narrow strap 80 will facilitate the use of a smaller or lower-profile reeltype winding device 70–76. Optionally, the bag 10 can include a handle 82 similar to the top side handle 14 positioned on one or both of the sides 24, 26 of the bag 10, adjacent to the shoulder strap 16, 18. As will be provided in more detail herein, the side handle 82 facilitates converting the bag 10 from a carry bag to a shoulder bag or backpack.

Figure 8:
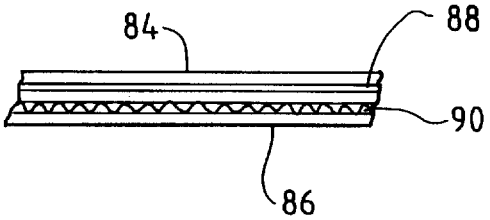
FIG. 8 is a cross-sectional view of the bag illustrating one embodiment of a layered construction thereof.

In a current embodiment of the bag 10 walls 20–30 are formed in a multi-layered configuration. FIG. 8 illustrates such a construction of the bag 10, which includes inner and outer shells 84, 86, respectively, that can be formed of, for example, a heavy gauge nylon or kevlar-type material. Those skilled in the art will recognize that such inner and outer shells 84, 86 can be formed from like material or from different materials, and can include a wide variety of both natural and synthetic materials. A preferred bag 10 construction includes at least one layer of a padding material 88, such as a high-density, closed-cell, non-absorbing foam. The padding layer 88 provides shock absorption in the event that the bag 10 strikes or is struck by an object. Such a padding layer 88 can prevent damage to sensitive objects, such as computers, that may be carried in the bag 10.

In order to maintain the "hourglass" shape of the bag 10, it is anticipated that rigid or semi-rigid panels 90 will be positioned between the inner and outer shells 84, 86. One contemplated panel 30 is formed of a honeycomb plastic material to provide lightweight, rigid shape to the bag 10. The honeycomb plastic material 50 not only provides shape to the bag 10, but also enhances the overall shock absorption capabilities of the bag 10.

Figure 7A:
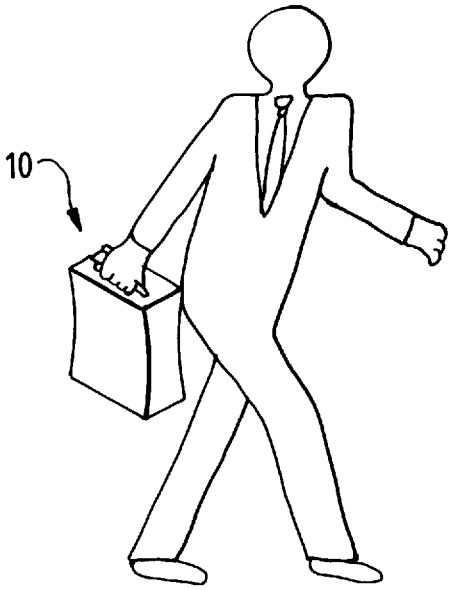
FIGS. 7*a* through 7*d* illustrate one manner of converting the bag from a handle carry bag to a shoulder bag and subsequently to a backpack.
Figure 7B:
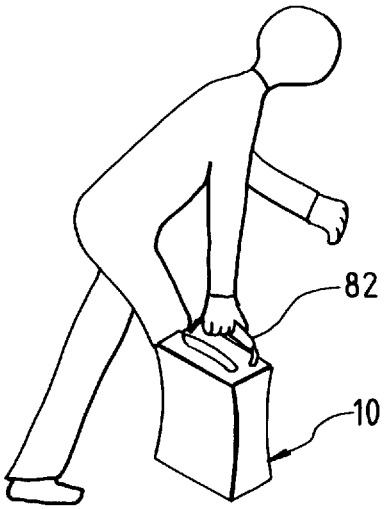

The retractable strap system 68 of the present convertible bag 10 readily facilitates converting the bag 10 from a carry bag to a shoulder bag and from a shoulder bag to a backpack. Referring now to FIGS. 7*a*–7*d*, the bag 10 is illustrated positioned such that it is resting on a side 26 with an opposing side 24 oriented vertically upward. As illustrated in FIG. 7*a*, the bag 10 can be carried this way by the side handle 82. Referring to FIG. 7*b*, while the bag 10 is resting on a side 26, a user grasps the visible shoulder strap 16 and pulls upward to retract the strap 16 to a desired length.

Figure 7C:
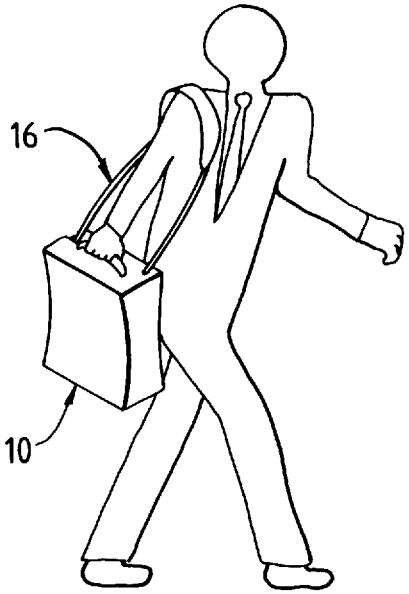

As provided previously herein, by simply snapping or quickly tugging on the shoulder strap 16, the reel-type winding devices 70–72 will lock the strap 16 at the desired retracted position. The strap 16 can thus be positioned with the padded portion 78 of the shoulder strap 16 on the user's shoulder as shown in FIG. 7*c*, and at the same time the user can grasp the side handle 82. In this manner, the bag 10 can be used as a shoulder bag with the shoulder strap 16 positioned on the user's shoulder and the side handle 82 can be used to assist carrying the bag 10 if desired. Because the reel-type winding devices 70–76 include an inertial-type lock, once positioned on the shoulder, the straps 16, 18 will not further retract so that the bag 10 can be positioned comfortably, without the shoulder strap 16, 18 inadvertently lengthening or shortening.

As described previously, the bag 10 has a substantially hourglass design which further permits comfortable use of the bag 10 by permitting the bag 10 to rest against the user's hip. This permits positioning the center of gravity of the bag 10 closer to the user. As will be readily apparent from the figures and the description, shifting the center of gravity of the bag 10 closer to the user, and resting a corresponding portion of the bag 10 at about the center of gravity at the user's hip, reduces the strain on the user's shoulder and/or back.

Figure 7D:
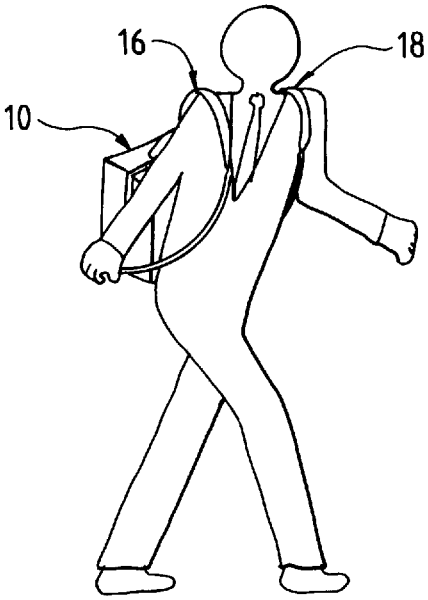

From the shoulder bag position, the bag 10 is readily converted to a backpack. As illustrated in FIGS. 7*c*–7*d*, the bag 10 can be rotated or swung from a user's hip toward the user's back. The opposing shoulder strap 18 can then be grasped and slipped over the user's shoulder. Again, the reel-type winding devices 74, 76 permit extracting the desired amount of shoulder strap 18 from the devices, 74, 76, to permit desirably positioning the shoulder strap 18 so as to position the convertible bag 10 on the user's back. The hourglass design of the bag 10 advantageously enhances comfort and use of the bag 10. As is apparent from the drawings, the hourglass design conforms to the user's back so that the bag 10 will more comfortably rest against the user's back. Once the bag 10 is positioned on the user's back, the straps 16, 18 can be further adjusted so that the bag 10, as a backpack, is positioned in a "most comfortable" position for the user.

When it is desired to use the bag 10 as a briefcase or hand-type bag, the shoulder straps 16, 18 can be removed from the user's shoulders and the straps 16, 18 can be retracted back into the reel-type devices 70–76 in the bag 10. In a most preferred embodiment, once removed from the user's shoulder, the shoulder straps 16, 18 will automatically retract into the bag 10 to provide an aesthetically pleasing, neat and acceptable outward appearance.

Those skilled in the art will recognize that the present invention, including the retractable strap system 68 can be used in conjunction with a wide variety of bags, such as baby diaper bags and the like. In another contemplated use, such a bag can be configured for the storage and transport of athletic equipment such as ski boots, in-line skates, ice skates and the like. Such other bag configurations are within the scope of the present invention.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A bag convertible between a hand-held bag, a shoulder bag and a back pack, comprising:

a bag having a body defining an interior storage space, the bag including a top wall, a bottom wall, a pair of side walls, a front wall and a back wall, the top and bottom walls having an hourglass shape;

a top handle positioned on the top wall of the body;

a pair of discrete, separate shoulder straps; and a pair of independently operable shoulder strap retraction systems, each of the retraction systems including at least one reel-type winding device operably connected to a respective strap for storing and selectively retracting and withdrawing a portion of the respective shoulder strap, each reel-type device being positioned in the bag, at least in part within the interior storage space, and associated with a respective opening in the body to withdraw and retract the respective shoulder strap therefrom, each strap being selectively positionable at a retracted position, a withdrawn position, and an intermediate position, wherein one strap is independently withdrawable from the bag from about the reel-type device to the withdrawn position to convert the bag from the hand-held bag to the shoulder bag, and wherein both straps are independently withdrawable from and retractable into the bag, each to the intermediate position, to convert the bag from the hand-held or shoulder bag to the back pack, each strap being independently adjustable in the intermediate position to provide a snug fit of the back pack to a user's back, and wherein the shoulder straps extend from the top wall spaced from the handle to a respective one of the side walls.

2. The bag in accordance with claim 1 wherein each shoulder strap retractioning stem includes a pair of reel-type winding devices, each device being connected to an end of a respective one of the shoulder straps.

3. The bag of claim 1 wherein the interior storage space is divided into a plurality of segregated storage regions.

4. The bag in accordance with claim 3 wherein at least one of the storage regions is configured to accommodate a laptop computer.

5. The bag in accordance with claim 1 including a zipper closure.

6. The bag in accordance with claim 1 including at least one pocket positioned on an inside surface of the front wall.

7. The bag in accordance with claim 1 wherein the bag body is formed of a layered construction having an inner shell and an outer shell.

8. The bag in accordance with claim 7 including a padding layer disposed between the inner shell and the outer shell.

9. The bag in accordance with claim 7 including a substantially rigid member disposed between the inner shell and the outer shell.

10. The bag in accordance with claim 1 wherein each side wall defines a recessed area configured to receive a respective shoulder strap when the shoulder strap is in the retracted position.

11. The bag in accordance with claim 10 wherein the top wall includes a pair of recessed areas, each contiguous with one of the side wall recessed areas, the top wall recessed areas being configured to receive the respective shoulder strap when the straps are in the retracted position.

12. A bag convertible between a hand-held bag, a shoulder bag and a back pack, comprising:

a bag having a body defining an interior storage space having a top portion, a bottom portion, opposingly facing side portions, a front portion and a rear portion, a handle positioned on the body;

a pair of discrete, separate shoulder straps; and a pair of independently operable shoulder strap retraction systems, each of the retraction systems including at least one reel-type winding device operably connected to a respective strap for storing and selectively retracting and withdrawing a portion of the respective shoulder strap, each reel-type device being positioned in the bag, at least in part within the interior storage space, and associated with a respective opening in the body to withdraw and retract the respective shoulder strap therefrom, each strap being selectively positionable at a retracted position, a withdrawn position, and an intermediate position, the straps being positioned on the body spaced from one another and extending from the body to a respective one of the side portions in opposing relation to one another, wherein one strap is independently withdrawable from the bag from about the reel-type device to the withdrawn position to convert the bag from the hand-held bag to a shoulder bag, and wherein both straps are independently withdrawable from and retractable into the bag, each to the intermediate position, to convert the bag from the hand-held or shoulder bag to a back pack, each strap being independently adjustable in to provide a snug fit of the back pack to a user's back wherein each side portion defines a recessed area configured to receive a respective shoulder strap when the shoulder strap is in the retracted position.

13. The bag in accordance with claim 12 wherein at least some of the top, bottom, sides, front and rear portions have a curved profile.

14. The bag in accordance with claim 12 wherein the top handle is positioned on the top portion, and each shoulder strap extends from the top portion spaced from the handle to a respective one of the side portions.

* * * * *